US008684376B2

(12) United States Patent
Wurst

(10) Patent No.: US 8,684,376 B2
(45) Date of Patent: Apr. 1, 2014

(54) THREE WHEEL LEAN-STEER SKATEBOARD

(76) Inventor: James Wurst, Oviedo, FL (US)

( * ) Notice: Subject to any disclaimer, the term of this patent is extended or adjusted under 35 U.S.C. 154(b) by 2 days.

(21) Appl. No.: 13/482,600

(22) Filed: May 29, 2012

(65) Prior Publication Data

US 2013/0175790 A1 Jul. 11, 2013

Related U.S. Application Data

(60) Provisional application No. 61/631,689, filed on Jan. 9, 2012.

(51) Int. Cl.
*A63C 17/01* (2006.01)
*A63C 17/04* (2006.01)

(52) U.S. Cl.
USPC ..... 280/87.042; 280/603

(58) Field of Classification Search
USPC ..... 280/87.041, 87.042, 87.05, 87.01, 603
See application file for complete search history.

(56) References Cited

U.S. PATENT DOCUMENTS

| | | | | |
|---|---|---|---|---|
| 4,194,752 | A | 3/1980 | Tilch | |
| 4,337,961 | A | 7/1982 | Strickman et al. | |
| 4,681,333 | A * | 7/1987 | Rouge et al. | 280/87.042 |
| 4,711,459 | A | 12/1987 | Liu | |
| 4,793,444 | A | 12/1988 | Nagano | |
| 4,842,148 | A | 6/1989 | Bowman | |
| 4,991,861 | A | 2/1991 | Carn | |
| 5,029,887 | A | 7/1991 | Grutzner | |
| 5,100,161 | A | 3/1992 | Tillyer | |
| 5,160,155 | A | 11/1992 | Barachet | |
| 5,330,214 | A | 7/1994 | Brooks | |
| 5,474,314 | A | 12/1995 | Lehman | |
| 5,507,513 | A | 4/1996 | Peters | |
| 5,551,717 | A | 9/1996 | Milne | |
| 5,645,291 | A | 7/1997 | Ramage | |
| 5,794,955 | A | 8/1998 | Flynn | |
| 5,860,657 | A | 1/1999 | Kroher | |
| 5,997,018 | A | 12/1999 | Lee | |
| 6,079,727 | A * | 6/2000 | Fan | 280/265 |
| 6,109,397 | A | 8/2000 | Chen | |
| 6,206,388 | B1 | 3/2001 | Ouboter | |

(Continued)

FOREIGN PATENT DOCUMENTS

KR 1020000009065 2/2000

OTHER PUBLICATIONS

PCT Search Report, PCT/US2013/020669, received on Apr. 25, 2013, 10 pages.

(Continued)

*Primary Examiner* — Frank Vanaman
(74) *Attorney, Agent, or Firm* — Brian S. Steinberger; Law Offices of Brian S. Steinberger, P.A.

(57) ABSTRACT

Skateboard devices, and methods of riding and steering an elongated foldable skateboard with two large front wheels pivotally attached to the front of the skateboard and a single large rear centered wheel with depressible brake. The skateboard allows for the rider with one foot on the skateboard to propel the skateboard by pushing off the ground with another foot. A stabilizing assembly with angled bolt/pin/rod that inserts into an oblong eyelet opening with pliable bushing on the front axle can allow for the rider to tilt the board with their weight to turn the skateboard to the left or to the right.

8 Claims, 20 Drawing Sheets

(56) References Cited

U.S. PATENT DOCUMENTS

| | | | | |
|---|---|---|---|---|
| 6,254,113 | B1 | 7/2001 | Dornan | |
| 6,270,096 | B1 | 8/2001 | Cook | |
| 6,279,930 | B1 | 8/2001 | Chang | |
| 6,315,304 | B1 * | 11/2001 | Kirkland et al. | 280/11.28 |
| 6,338,494 | B1 | 1/2002 | Killian | |
| 6,341,790 | B1 | 1/2002 | Chen | |
| 6,382,646 | B1 | 5/2002 | Shaw | |
| 6,398,237 | B1 | 6/2002 | Attey | |
| 6,523,837 | B2 * | 2/2003 | Kirkland | 280/11.28 |
| 6,568,695 | B2 | 5/2003 | Dornan | |
| 6,832,771 | B2 | 12/2004 | Beck | |
| 6,926,294 | B2 | 8/2005 | Lewis | |
| D527,771 | S | 9/2006 | Iavarone et al. | |
| D569,448 | S | 5/2008 | Sramek | |
| D575,352 | S | 8/2008 | Sramek | |
| 7,487,987 | B2 | 2/2009 | Yan | |
| 7,926,825 | B2 | 4/2011 | Chen | |
| 8,025,300 | B1 | 9/2011 | Jordan | |
| 8,075,006 | B2 | 12/2011 | Smith | |
| 8,342,546 | B2 * | 1/2013 | Bryant | 280/87.041 |
| 2002/0096842 | A1 | 7/2002 | Chang | |
| 2007/0182123 | A1 * | 8/2007 | Bryant | 280/271 |
| 2008/0211296 | A1 | 9/2008 | Takachi | |
| 2010/0123295 | A1 * | 5/2010 | Landau | 280/87.042 |

OTHER PUBLICATIONS

International Search Report, PCT/US13/20669 filed Jan. 8, 2013, received on Apr. 25, 2013, 10 pages.

* cited by examiner

THREE WHEEL LEAN-STEER SKATEBOARD

CROSS REFERENCE TO RELATED APPLICATIONS

This invention claims the benefit of priority to U.S. Provisional Application Ser. No. 61/631,689 filed Jan. 9, 2012.

FIELD OF INVENTION

This invention relates to skateboards, and in particular to skateboard devices, and methods of riding and steering an elongated foldable skateboard with two large front wheels and a single large rear centered wheel with depressible brake, so that the rider with one foot on the skateboard can propel the skateboard by pushing off the ground with another foot.

BACKGROUND AND PRIOR ART

The usual conventional skateboards use four small diameter wheels positioned beneath the board on which the rider stands. The wheels are made of a solid material that provides no shock absorption. The board is propelled by the rider by kicking one foot on the ground. Steering is accomplished by shifting the rider's weight to tilt the board. The limitation of this version is that the small diameter wheels can only be used on smooth surfaces that are free of debris.

New types of skateboards have been proposed over the years to overcome the limitations of the small wheels by creating skateboards with large diameter wheels and pneumatic tires. However, these boards cannot be easily propelled by the rider. The large wheel boards have higher riding platforms which makes the boards unstable, difficult to ride, and potentially unsafe to the rider. Most of these other types of boards are propelled only by gravity and thus require a sloping surface for any use.

U.S. Pat. No. 6,398,237 to Attey describes a skateboard that utilizes two in-line large diameter wheels where a single front wheel pivots to accommodate steering. Similar to a bicycle, with only two wheels this device can only remain vertical while in motion. A rider would not be able to remove one foot from the device for propulsion without losing stability and falling off the board.

U.S. Pat. No. 5,794,955 to Flynn describes a mountain board that requires four large diameter wheels which are mounted on wide axles that extend beyond the width of the board. The two wheels at the rear of the board can cause interference for the rider should the rider attempt to propel the board by kicking one foot.

U.S. Pat. No. 5,100,161 to Tillyer; U.S. Pat. No. 5,997,018 to Lee; U.S. Pat. No. 5,645,291 to Ramage; and U.S. Pat. No. 5,474,314 to Lehman also each require four large wheels located beneath the board that results in a high riding platform, or 'deck,' which makes these devices cumbersome and difficult to operate.

U.S. Pat. No. 5,551,717 to Milne has two front wheels that steer and a single rear wheel; however, this device is much less stable. Milne's design includes a deck that is mounted to the frame via longitudinal pivot points beneath the deck. This allows the deck to tilt from side to side while the frame remains level. Steering linkage components connected to the deck turn the front wheels when the deck is tilted. The deck is higher than the axles of the wheels. The combination of the high deck and the pivot point located below the plane in which the rider stands makes this unstable. Additionally, the Milne's device appears to be limited for off-road use only and may further be limited to use on sloping surfaces.

Thus, the need exists for solutions to the above problems with the prior art.

SUMMARY OF THE INVENTION

A primary objective of the present invention is to provide skateboard devices, and methods of riding and steering an elongated steerable and foldable skateboard with two large front wheels and a single large rear centered wheel that can be ridden on a variety of terrain surfaces.

A secondary objective of the present invention is to provide skateboard devices, and methods of riding and steering an elongated steerable and foldable skateboard with two large front wheels and a single large rear centered wheel, where the wheels can have shock absorption effects.

The steerable and foldable skateboard invention can be ridden on a variety of terrain and can also be propelled by the rider. The invention is not limited to off-road use only as it can be used on a variety of uneven paved surfaces like asphalt even if the riding surface is level.

An embodiment of the board is to have three wheels which create a stable platform having two wheels in the front and one wheel medially disposed in the rear. The single rear wheel can provide clearance for the rider's foot so the rider can propel the board by kicking along the ground.

The wheels are generally of a large diameter to allow the board to travel on irregular surfaces. The wheels can have pneumatic tires to provide shock absorption. In practice it has been found the preferred wheel diameters are in the approximately 30 cm to approximately 60 cm range.

Two front wheels on the board can be pivotally connected to the frame to allow the wheels to turn and steer the board. The two front wheels can either be fixed to a common axle with a single pivot point centered about the axle or they can be mounted with a separate pivot point for each front wheel for a total of two pivot points.

From experience it has been found that when the pivot point or points are angled forward between approximately 10 degrees to approximately 45 degrees off vertical it causes the front wheels to turn when the riding platform is tilted left or right.

It has also been found that if a single pivot point is used to turn the front wheels it is best this pivot point lies in the same plane as the riding surface for more accurate responsiveness.

The axle track of the two front wheels can be narrow to keep the device compact, lightweight, and maneuverable. This width must increase as the diameter of the wheels increases as to prevent the wheels from contacting the frame while turning. The preferred width of the axle track is between approximately 30 cm and approximately 42 cm.

A frame supporting a riding platform can be positioned between the front and rear wheels. Preferably the frame will position the axles of the wheels in a plane above the plane of the riding platform which increases stability and keeps the riding platform low to the ground. The height of the riding surface is comparable to that of a conventional skateboard.

The riding platform can be stabilized by stabilizing the pivot or pivots with material, such as but not limited to rubber or polyurethane bushings. The overall wheelbase is preferably in the about 70 cm to about 117 cm range, and the ideal wheelbase of the device would vary based on the size of the rider.

The pivot and steering mechanisms can include a raised eyelet on a middle portion of the axle member, the eyelet having an enlarged opening therethrough, and a stabilizing member attached to the frame having an angled rod with an end attached into the enlarged opening in the eyelet with a pliable bushing, the enlarged opening having a larger diameter than the diameter of the rod, the opening being large enough to allow for the front wheels on the axle member with attached eyelet to move to the left and to the right without having inner edges of the opening in the eyelet from contacting the rod, wherein the stabilizing member allows for turning of the skateboard when the skateboard is tilted to the right or to the left.

The frame can also separate along the lateral axis which will enable the device to fold for storage. When in the unfolded position, the rear section of the frame can be inserted a short distance into the front section of the frame. The front and rear sections can be drawn together by an attached handle and lever. The handle can be permanently attached to the front section of the frame by a pivotal connection. The lever can be permanently attached to the handle by a pivotal connection, and the lever can be permanently attached to the rear section of the frame by a pivotal connection so all components remain attached when the device is folded.

A folding mechanism can include a front frame and rear frame having male ends and female ends which couple with each other for stability with the front frame and the rear frame being drawn together by a lever pivotally connected to both the front and rear frames that holds both the front and the rear frames together when folded and tightly draws the front and the rear frames together when unfolded.

The three wheel lean-steer skateboard can accept attachments such as a handle that a rider can use for additional stability, or a sail that would enable the rider to be propelled by the wind.

The three wheel lean-steer skateboard is well suited to being modified to be powered by a motor, either gas or magnetic, which can drive the single rear wheel.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
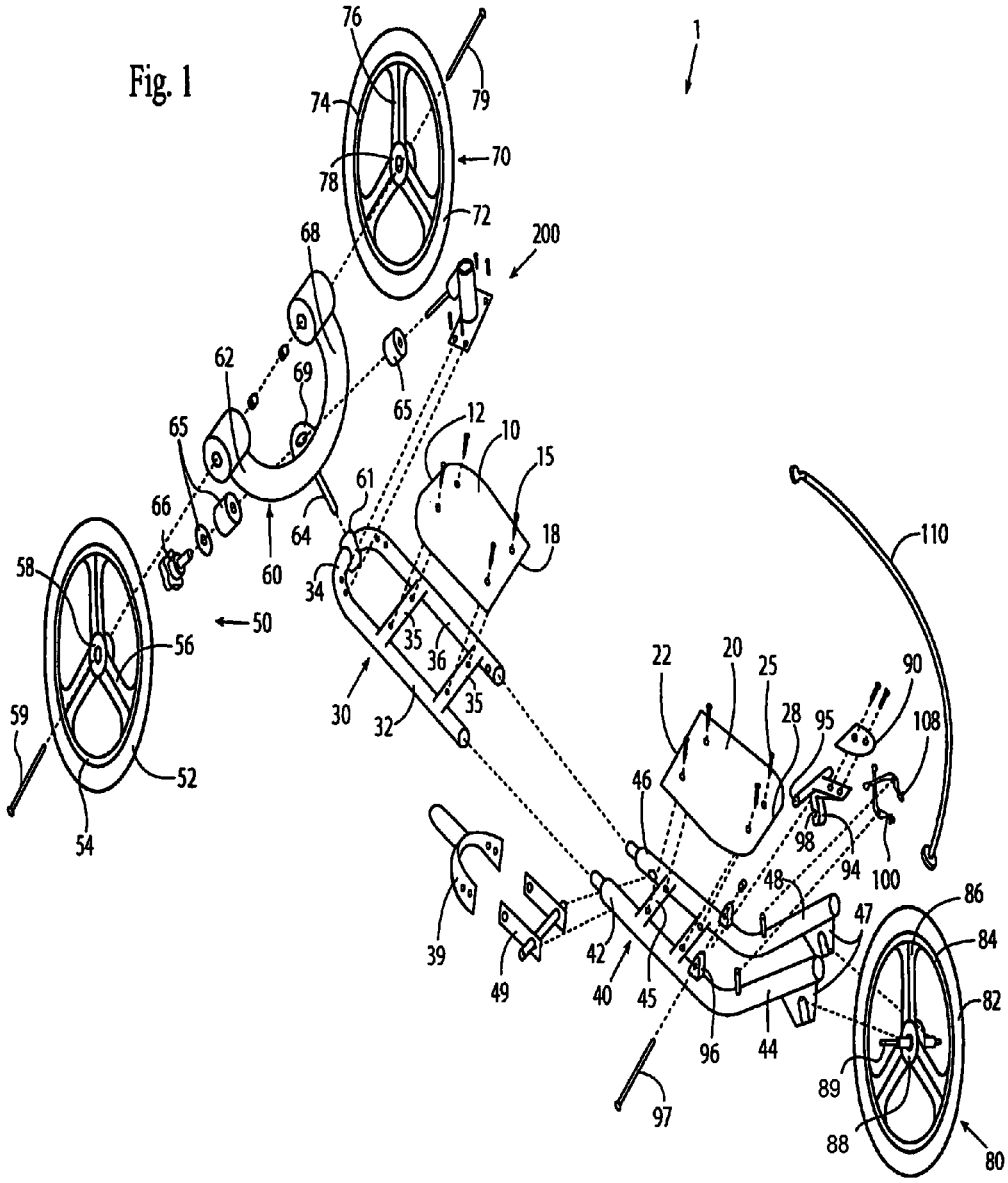
FIG. 1 is an exploded upper perspective view of the steerable and foldable skateboard.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

1. foldable skateboard
10. front deck
12. forward end
15. fastener(s)
18. back end
20. rear deck
22. forward end
25. fastener(s)
28. back end
30. U-shaped front frame
32. left elongated member
34. apex end
35. cross brace(s)
36. right elongated member
38. pivot point
39. fold-lock handle
40. rear frame
42. left elongated member
43. pivot point
44. left bent end
45. cross brace(s)
46. right elongated member
47. rear frame dropouts
48. right bent end
49. fold-lock lever
50. left front wheel
52. tire
54. rim
56. spoke(s)
58. center
59. fastener
60. main axle
61. solid bushing
62. left axle arm

Figure 1A:
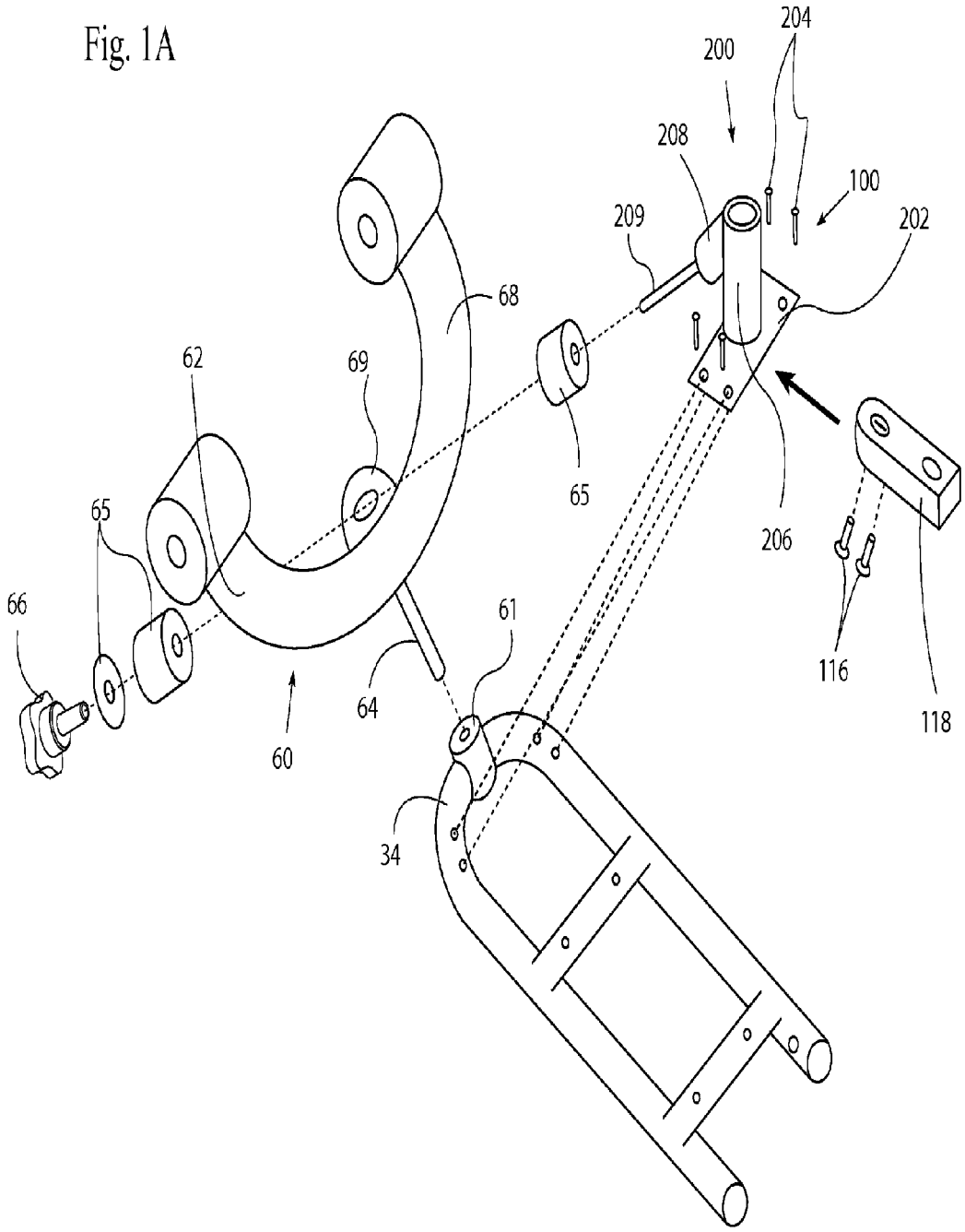
FIG. 1A is an enlarged exploded upper perspective view of the steering mechanism of the steerable and foldable skateboard of FIG. 1.
Figure 1B:
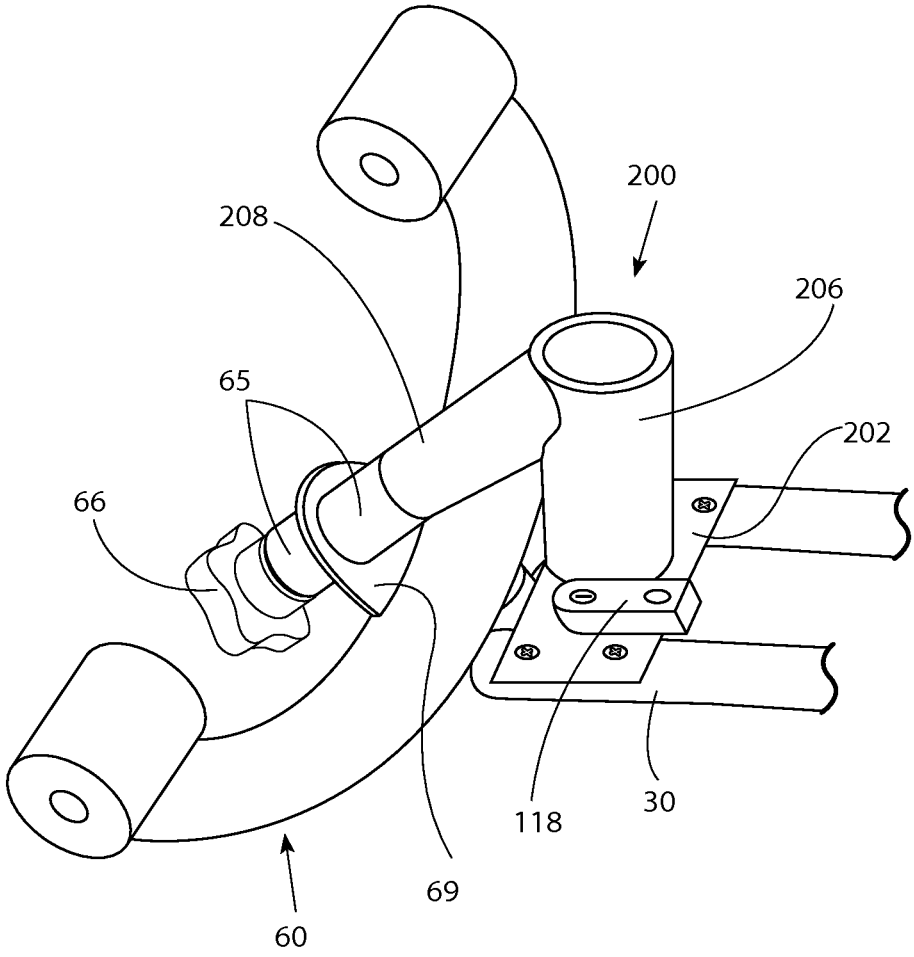
FIG. 1B is an enlarged upper perspective view of the steering mechanism of the steerable and foldable skateboard of FIG. 1.
Figure 2:
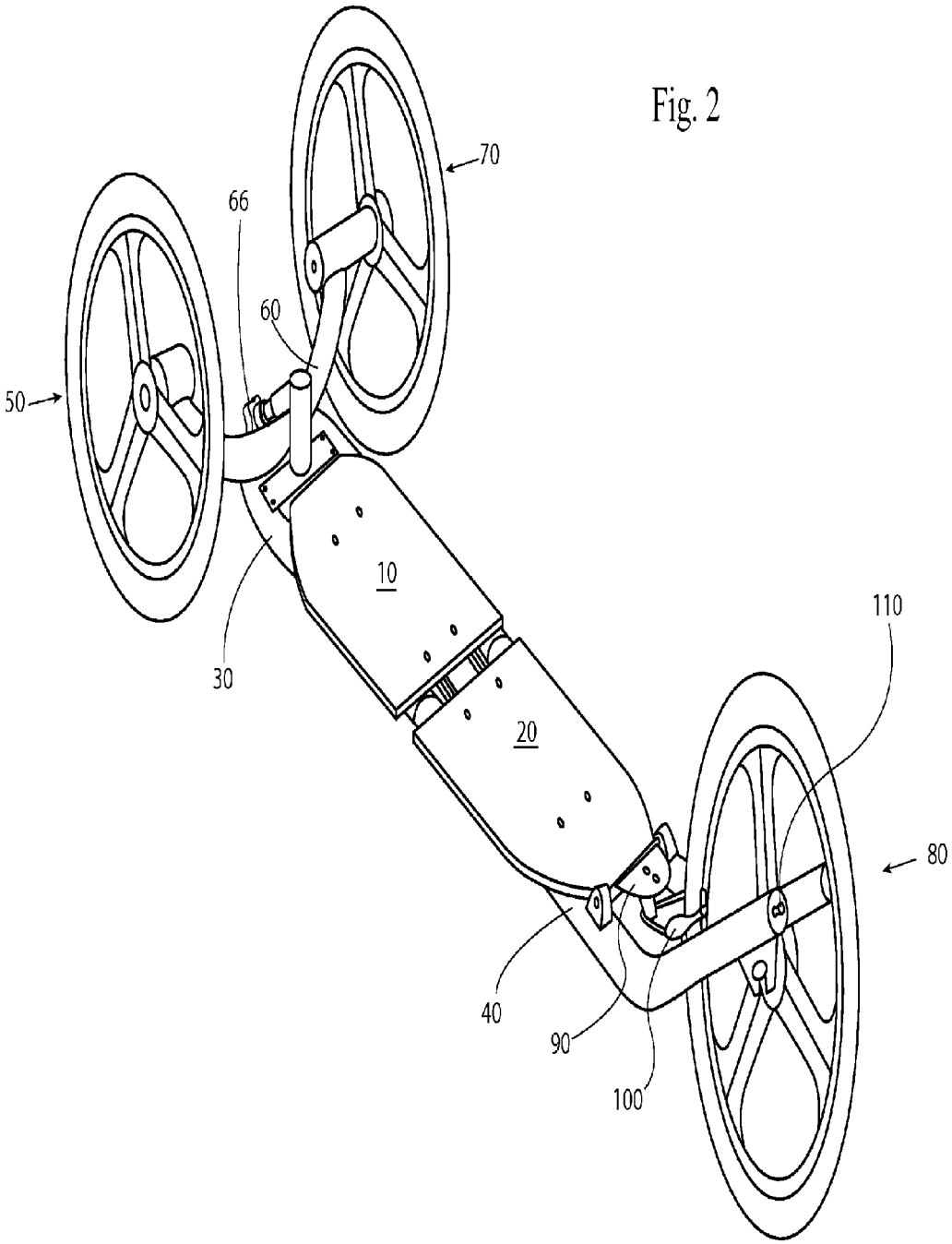
FIG. 2 is an assembled upper perspective view of the steerable and foldable skateboard of FIG. 1.
Figure 3:
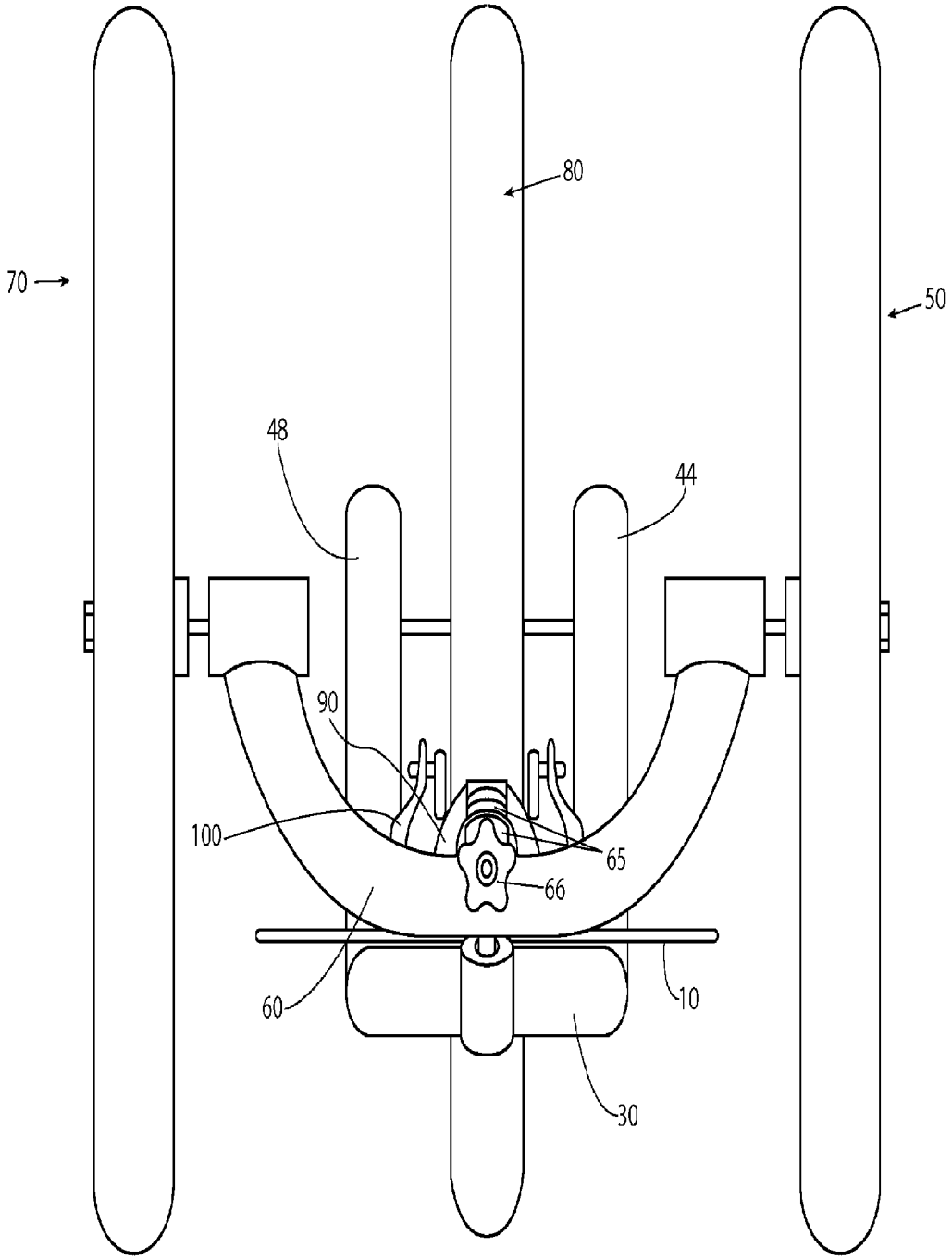
FIG. 3 is a front view of the steerable and foldable skateboard of FIG. 1.
Figure 4:
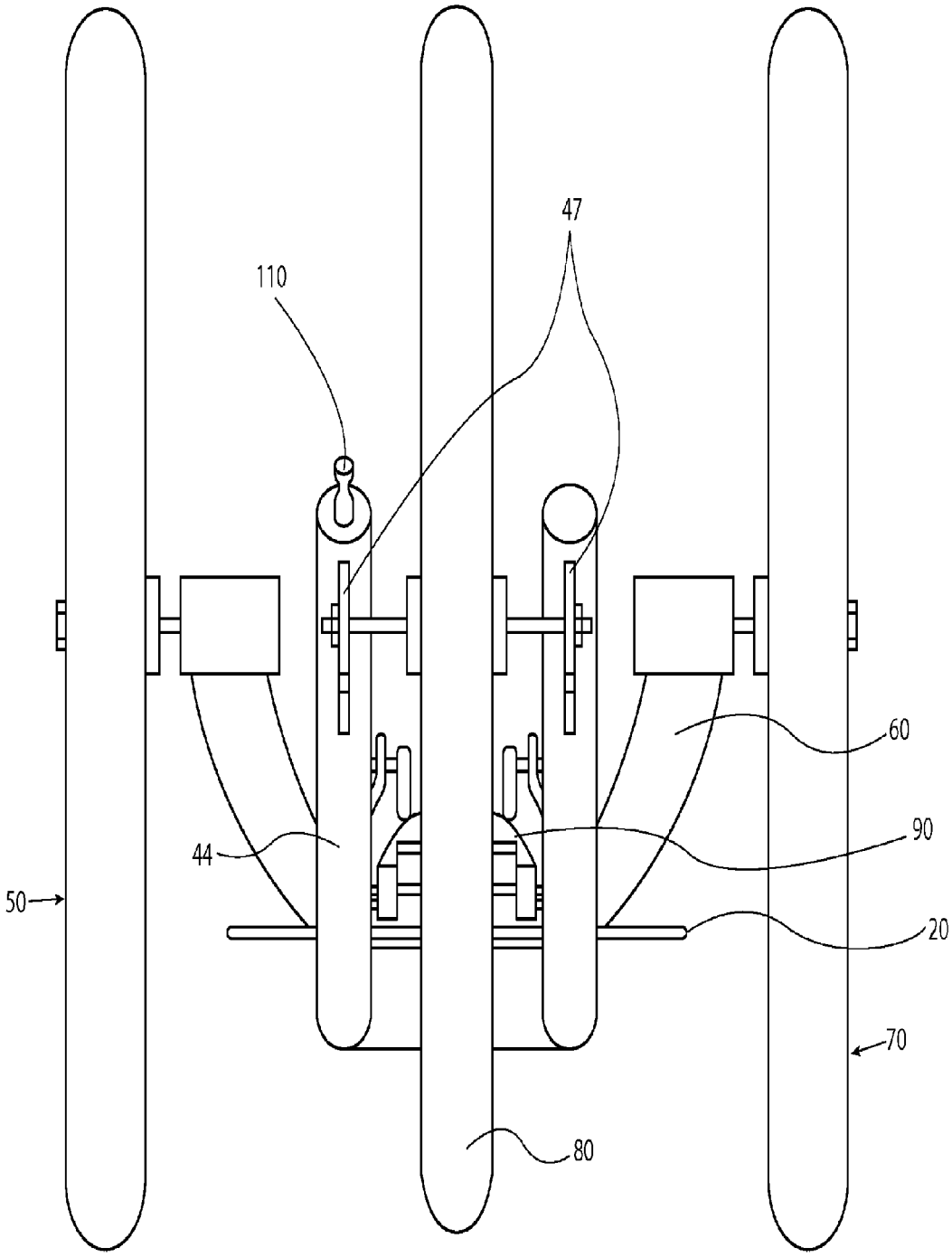
FIG. 4 is a rear view of the steerable and foldable skateboard of FIG. 1.
Figure 5:
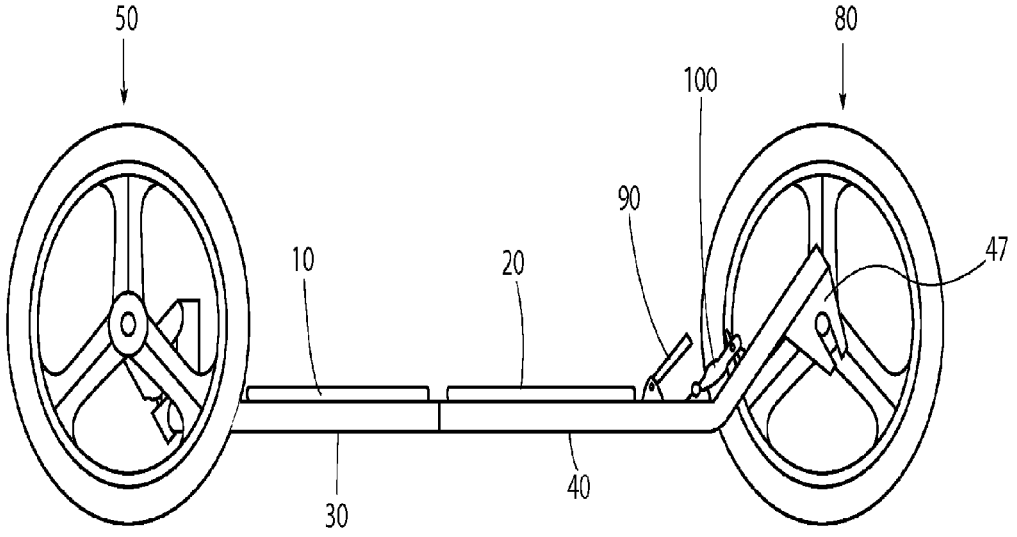
FIG. 5 is a left side view of the steerable and foldable skateboard of FIG. 1.
Figure 6:
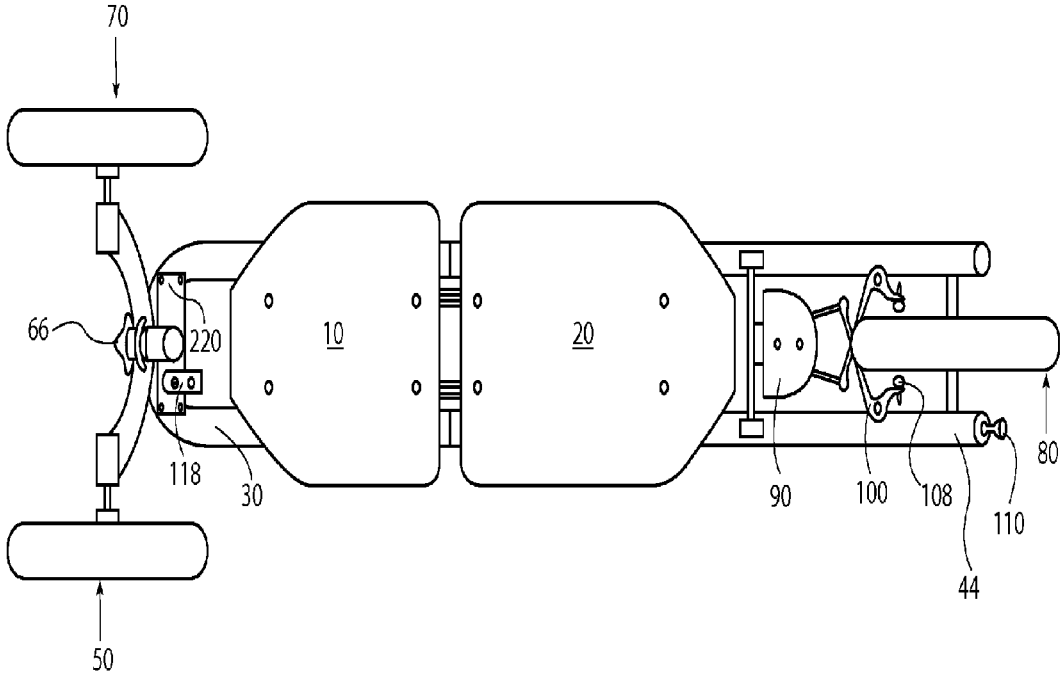
FIG. 6 is a top view of the steerable and foldable skateboard of FIG. 1.
Figure 7:
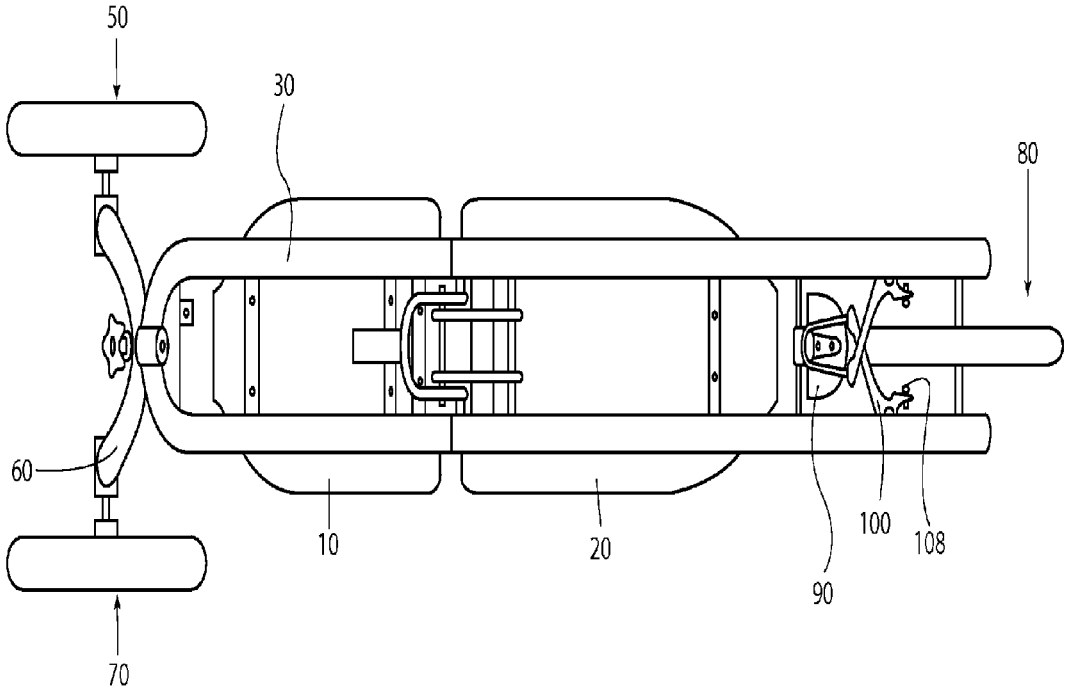
FIG. 7 is a bottom view of the steerable and foldable skateboard of FIG. 1.

64. main axle pivot bolt/pin/rod
65. bushing(s)/washer(s)
66. threaded knob
68. right axle arm
69. metal eyelet
70. right front wheel
72. tire
74. rim
76. spoke(s)
78. center
79. fastener
80. rear wheel
82. tire
84. rim
86. spoke(s)
88. center
89. rear wheel axle
90. brake pedal
92. depressible member
94. generally L shaped leg
95. pivot point(s)
96. rear frame pivot mount(s)
97. pivot pin
98. leg catch end
99. brake cable(s)
100. Pull Cable Brake, such as U-brake
108. brake shoe(s)
110. lock cable
116. fastener(s)
118. lock flange with socket
130. bike rack
140. rider
160. handle
180. sail
200. stabilizing bolt assembly
202. stabilizing bolt assembly mounting plate
204. fastener(s)
206. vertical portion of stabilizing bolt assembly
208. angled portion of stabilizing bolt assembly
209. stabilizing bolt FIG. 1 is an exploded upper perspective view of the novel foldable skateboard 1. FIG. 1A is an enlarged exploded upper perspective view of the steering mechanism of the steerable and foldable skateboard 1 of FIG. 1. FIG. 1B is an enlarged upper perspective view of the steering mechanism of the steerable and foldable skateboard 1 of FIG. 1. FIG. 2 is an assembled upper perspective view of the steerable and foldable skateboard 1 of FIG. 1. FIG. 3 is a front view of the steerable and foldable skateboard 1 of FIG. 1. FIG. 4 is a rear view of the steerable and foldable skateboard 1 of FIG. 1. FIG. 5 is a left side view of the steerable and foldable skateboard 1 of FIG. 1. FIG. 6 is a top view of the steerable and foldable skateboard 1 of FIG. 1. FIG. 7 is a bottom view of the steerable and foldable skateboard 1 of FIG. 1.

Referring to FIGS. 1-7, the novel foldable and steerable skateboard 1 can include a front deck 10 having a forward end 12 and a back end 18 with fastener(s) 15, such as screws, bolts and the like, that can attach the front deck 10 to the U-shaped front frame 30. The front frame 30 can include a left elongated member 32, apex end 34 and right elongated member 36 of the U-shaped front frame 30. The elongated member 32, 36 can be stiffened by cross brace(s) 35. Skateboard 1 can further include a rear deck 20 having a forward end 22 and a back end 28 with fastener(s) 25, such as screws, bolts, and the like, that can attach the rear deck 20 to the rear frame 40. The rear frame 40 can include a left elongated member 42 with left bent end 44 and right elongated member 46 with right bent end 48 which can be further stiffened by cross brace(s) 45.

The height of the decks 10, 20 can be off the ground preferably in the approximately 6 cm to approximately 12 cm range, although it has been found the ideal height is approximately 11 cm which allows room for the pneumatic tires 52, 72, 82 to compress when the rider's weight is applied and still provide adequate ground clearance. The rear of the frame 40 will curve upward to extend to the point of the rear axle center 88 of the rear wheel 80.

A pair of left and right front wheels 50, 70 can be attached to a front apex end 34 of the front frame 30 with a main axle 60. Each of the front wheels 50, 70 can include a tire portion 52, 72, attached to a circular rim 54, 74 that connect to a center 58, 78 by respective spokes 56, 76. The front wheels 50, 70 can be attached to outer ends of bent arms 62, 68 of the main axle 60 by respective wheel fastener type bolts 59, 79. The bent axle arms 62, 68 can be bent down and inward toward the middle.

A single rear wheel 80 can include a tire portion 82 attached to a circular rim 84 that connects to a center 88 by spokes 86. Rear wheel 80 be attached by outwardly extending axle pin(s) 89 to rear lower facing dropouts 47 on the bent ends 44, 48 of the rear frame 40, and can be held in place by typical nuts, and the like.

Each of the wheels 50, 70 and 80 can be large wheels having a diameter of approximately 30 cm to approximately 60 cm, and the tires 52, 72, 82 can be solid rubber or pneumatically filled which can have a shock absorbing effect.

Figure 8:
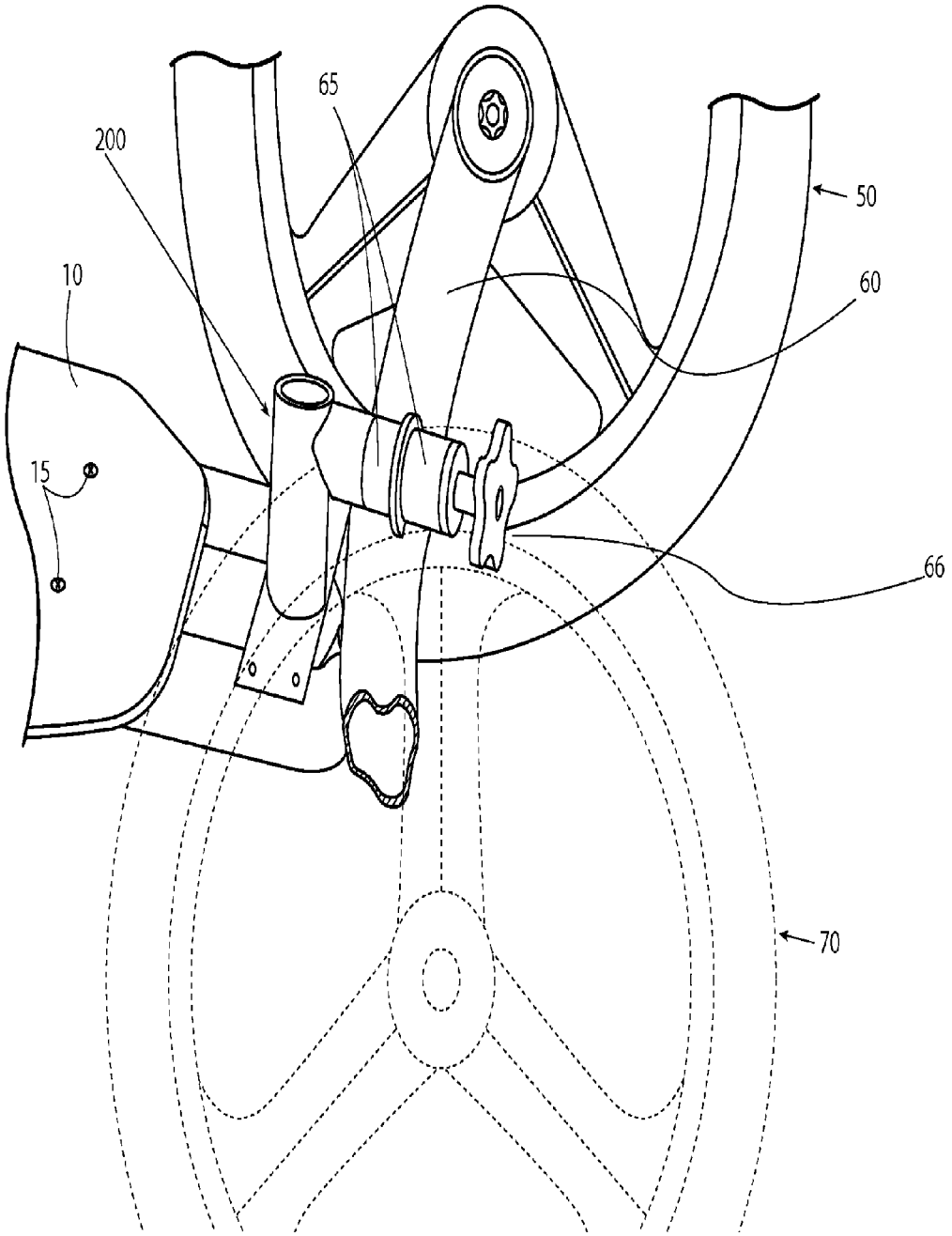
FIG. 8 is an enlarged top view of the steering mechanism of the skateboard of FIG. 1.
Figure 9:
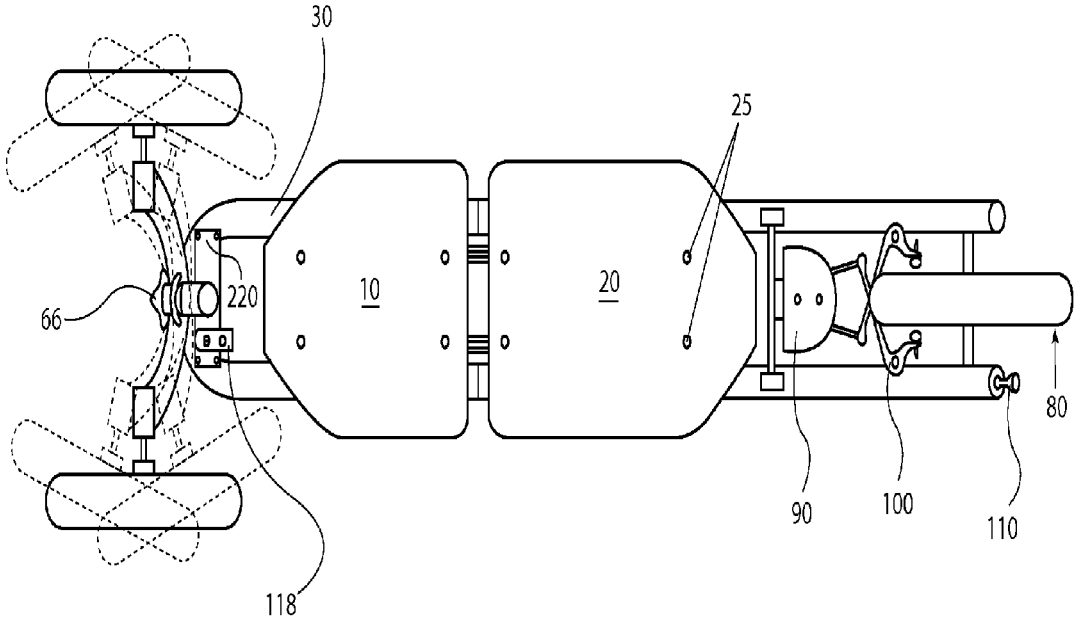
FIG. 9 is a top view of the steerable and foldable skateboard of FIG. 1 showing front steerable wheels.

FIG. 8 is an enlarged top view of the steering mechanism of the skateboard 1 of FIG. 1. FIG. 9 is a top view of the foldable and steerable skateboard 1 of FIG. 1 showing front steerable wheels 50, 70.

Referring to FIGS. 1-3, 6-9, and 15, the front wheels 50, 70 can be pivotally attached to the front frame 30. The main axle 60 can be pivotally attached to the apex portion 34 of the front frame 30 by a bolt 64 which passes through a solid bushing 61 that is attached to the apex end of the frame 34. The solid bushing 61 can be angled to be forward offset from the front frame 30 by an angle, which allows the arms 62, 68 of the axle 60 to be approximately 10 degrees to approximately 45 degrees off vertical which forces the pair of front wheels 50, 70 to turn when the skateboard 1 is tilted side-to-side by the rider 140 (shown in FIG. 16).

The solid bushing 61 can be angled forward by at least 10 degrees off vertical which forces the front axle 60 to rotate when the forward and rear decks 10, 20 are tilted which allows the skateboard 1 to turn as shown in FIG. 9. The pivot point where the main axle pivot bolt 64 inserts into the solid bushing 61 lies in the same plane as the riding surface of the decks 10, 20.

Referring to FIGS. 1A and 1B, the main axle 60 can be stabilized by rubber or polyurethane bushings 65 mounted on either side of a metal eyelet 69 that is attached to the main axle 60. The rubber bushings 65 can be held in place by a stabilizing bolt assembly 200 that is attached to the U-shaped front frame 30 by fasteners 204. The stabilizing bolt assembly 200 holds the stabilizing bolt 209 which passes through the metal eyelet 69. A turn knob 66 is threadably attached to the stabilizing bolt 209 enabling the user to adjust steering tension on the fly by tightening or loosening the knob 66 and compressing or decompressing the rubber bushings 65.

Referring to FIGS. 1A, 1B, 2, and 16, Steering is accomplished by having the main axle pivot bolt 64 permanently attached to the main axle 60 in the middle of the axle 60 protruding downward. The main axle pivot bolt 64 can be inserted into a solid metal bushing 61 that is attached to the front frame 30 and the main axle pivot bolt 64 can be secured with a nut below the bushing 61 on the bottom of the frame. This allows the main axle 60 to spin within the solid bushing 61. The solid metal bushing 61 can be mounted on an angle leaning forward by 10 degrees to 45 degrees off vertical. By mounting the bushing 61 on a forward angle this causes the frame 30, 40 to tilt to the side when the main axle 60 turns. Conversely, if the frame 30, 40 is tilted it causes the main axle 60 to turn.

When the main axle 60 is perpendicular to the frame 30, 40, the front wheels 50, 70 can be pointed straight forward and the frame 30, 40 is level. When the main axle 60 pivots to the right (clockwise), the frame 30, 40 tilts to the right. When the main axle 60 pivots to the left (counterclockwise), the frame 30, 40 tilts to the left. The frame 30, 40 must be stabilized in the level position for the rider 140 to be able to ride the skateboard 1. The frame 30, 40 should only tilt when the rider 140 forces the frame 30, 40 to tilt in order to steer the front wheels 50, 70 in the direction the rider 140 wants to go.

To stabilize the frame 30, 40 in the level position, the main axle 60 must be stabilized in the straight forward position. This is accomplished by attaching a metal eyelet 69 on top of the main axle 60 directly in line with the main axle 60 and perpendicular to the frame. The metal eyelet 69 can be a flat piece of metal that contains an elliptical hole in the middle. The metal eyelet 69 is centered in the same axis in which the main axle 60 pivots, directly above the main axle pivot bolt 64. The stabilizing bolt 209 which is attached to the front frame 30 passes through the middle of the elliptical hole in the metal eyelet 69. The elliptical hole in the eyelet 69 can provide enough clearance around the stabilizing bolt 209 so the bolt 209 does not come in to contact with the eyelet 69 when the main axle 60 turns.

There can be two rubber bushings 65 that are mounted on the stabilizing bolt 209 on either side of the metal eyelet 69 sandwiching the eyelet 69 between the two bushings 65. The rubber bushings 65 can be compressed slightly by tightening a threaded knob 66 onto the stabilizing bolt 209. This holds the metal eyelet 69 and thus the main axle 60 in a position that is perpendicular to the frame.

When the main axle 60 is turned, the metal eyelet 69 must apply force against the rubber bushings 65 and the spring-like properties of the rubber bushings 65 try to resist this force. This means force must be applied to turn the main axle 60 and when that force is removed the rubber bushings 65 return the main axle 60 to the straight forward position. When tilting force is applied to the frame 30, 40 by the rider 140 this force transfers to the turning motion of the main axle 60 which is resisted by the rubber bushings 65. The amount of tilting force necessary to turn the front wheels 50, 70 can be adjusted by the rider 140 by either tightening or loosening the threaded knob 66 and thus compressing or decompressing the rubber bushings 65 against the metal eyelet 69.

Figure 10:
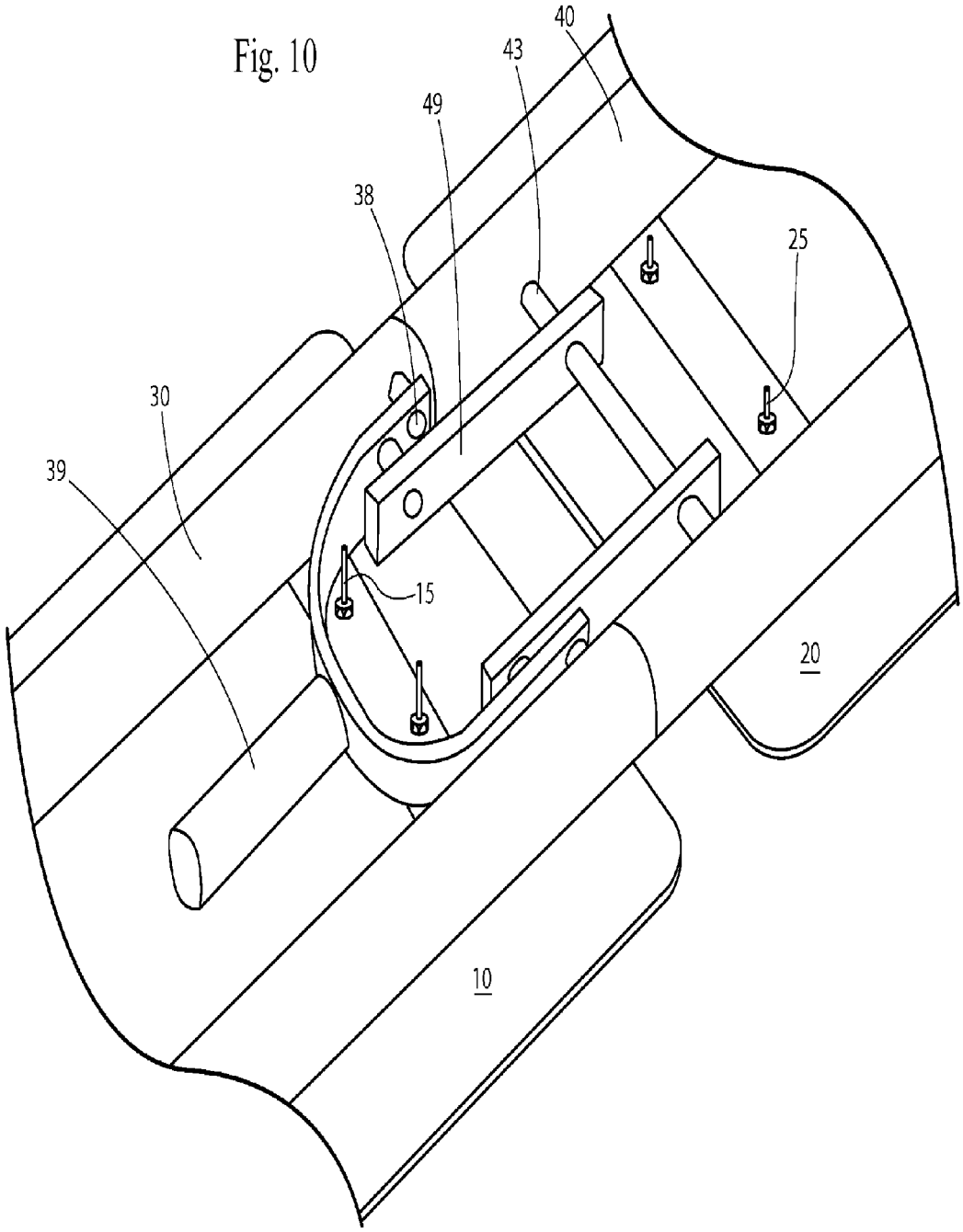
FIG. 10 is an enlarged bottom perspective view of the folding mechanism of steerable and foldable skateboard of FIG. 1 with the skateboard in an unfolded position.
Figure 11:
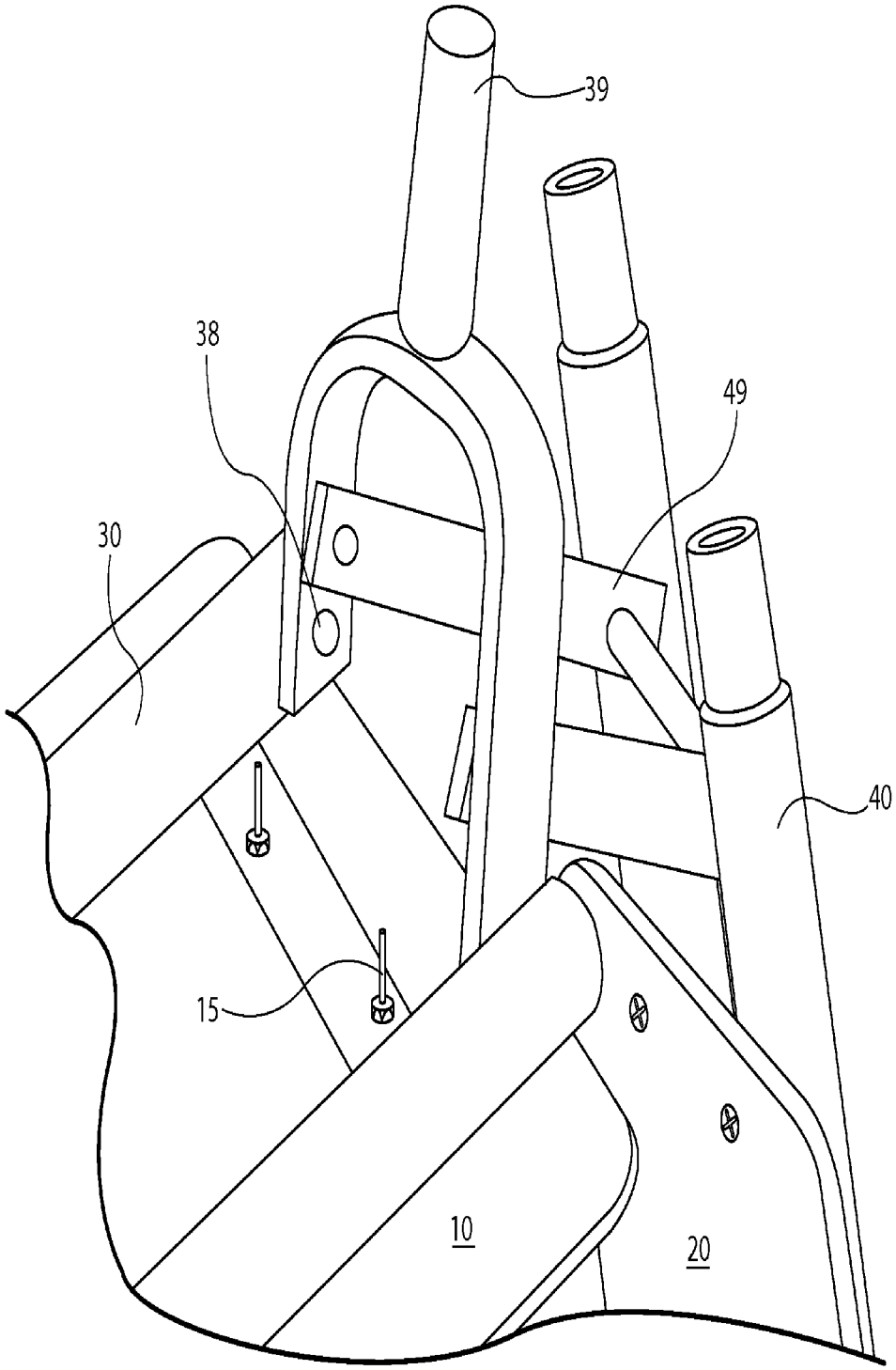
FIG. 11 is another enlarged bottom perspective view of the folding mechanism of the skateboard of FIG. 1 with the skateboard in a partially folded position.
Figure 12:
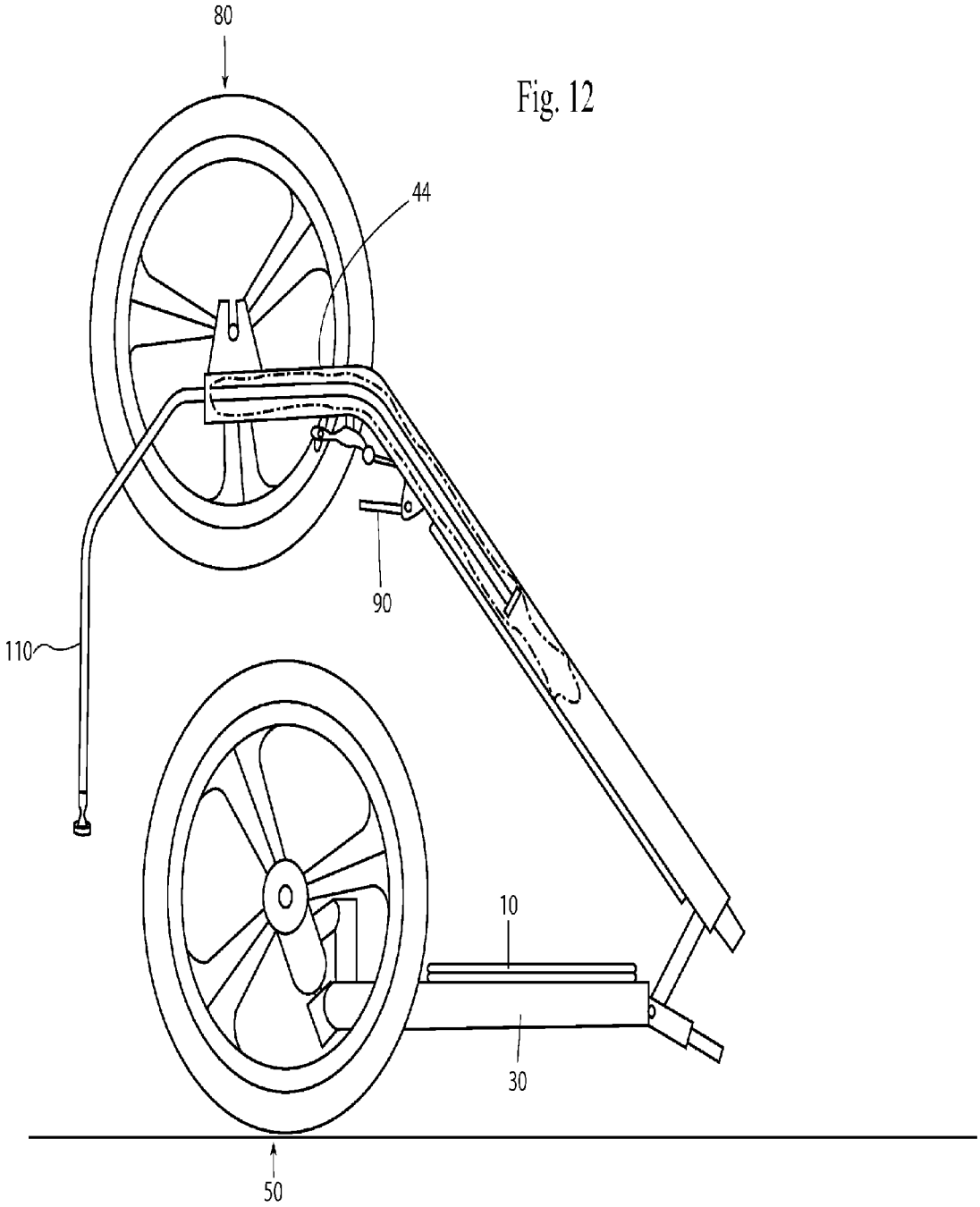
FIG. 12 is a side view of the skateboard of FIG. 1 with partially folded mechanism of FIG. 11 with skateboard in a partially folded position.
Figure 13:
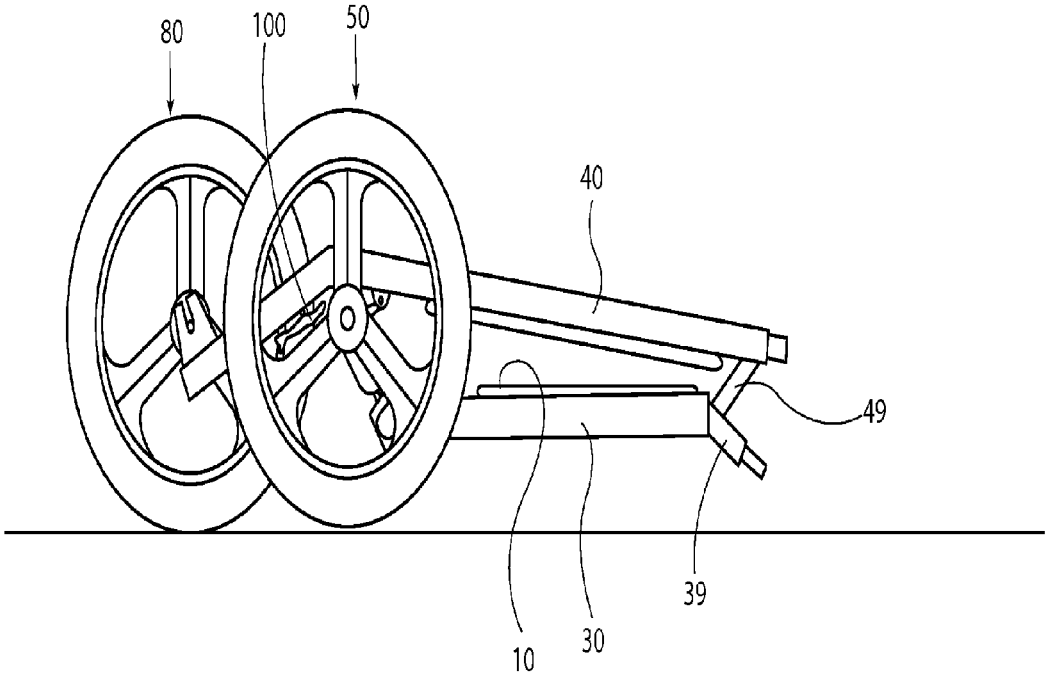
FIG. 13 is a side view of the skateboard of FIG. 1 and FIG. 12 with the skateboard in a fully folded position.

FIG. 10 is an enlarged bottom perspective view of the folding mechanism of foldable skateboard 1 of FIG. 1 with the skateboard 1 in an unfolded position. FIG. 11 is another enlarged bottom perspective view of the folding mechanism of the foldable skateboard 1 of FIG. 1 with the skateboard 1 in a partially folded position. FIG. 12 is a side view of the skateboard 1 of FIG. 1 with partially folded mechanism of FIG. 11 with skateboard 1 in a partially folded position. FIG. 13 is a side view of the skateboard 1 of FIG. 1 and FIG. 12 with the skateboard 1 in a fully folded position.

Referring to FIGS. 1, 2, 5-7, and 9-13, the skateboard 1 can have a front deck 10 attached to a front frame 30 that can fold against a rear deck 20 attached to a rear frame 40 by separating the two frame sections 30, 40. The rear frame 40 will insert into the front frame 30 by approximately 2 cm to approximately 6 cm. The fold-lock handle 39 can pivotally attach to the left and right elongated members 32, 36. One end of the fold-lock lever 49 can pivotally attach to the fold-lock handle 39 while the other end can pivotally attach to the left and right elongated members of the rear frame 42, 46. When the fold-lock handle 39 is laid flat against the bottom of the front deck 10 the fold-lock lever 49 is pulled forward and the front frame 30 and rear frame 40 are drawn together locking the skateboard 1 into the unfolded position as seen in FIG. 10. When the fold-lock handle 39 is pulled downward away from the front deck 10, the fold-lock lever extends and pushes front frame 30 and rear frame 40 apart allowing the skateboard 1 to be folded as seen in FIG. 11. The fold-lock handle 39 is permanently attached to front frame 30 by two pivot points 38. The fold-lock lever 49 is permanently attached to the fold-lock handle 39 as well as to the rear frame 40 by a pivot 43. This allows the front frame 30 and rear frame 40 to remain attached while folding the skateboard 1. The folded skateboard 1 allows for the unused skateboard 1 to be easily stored and/or transported.

Figure 14:
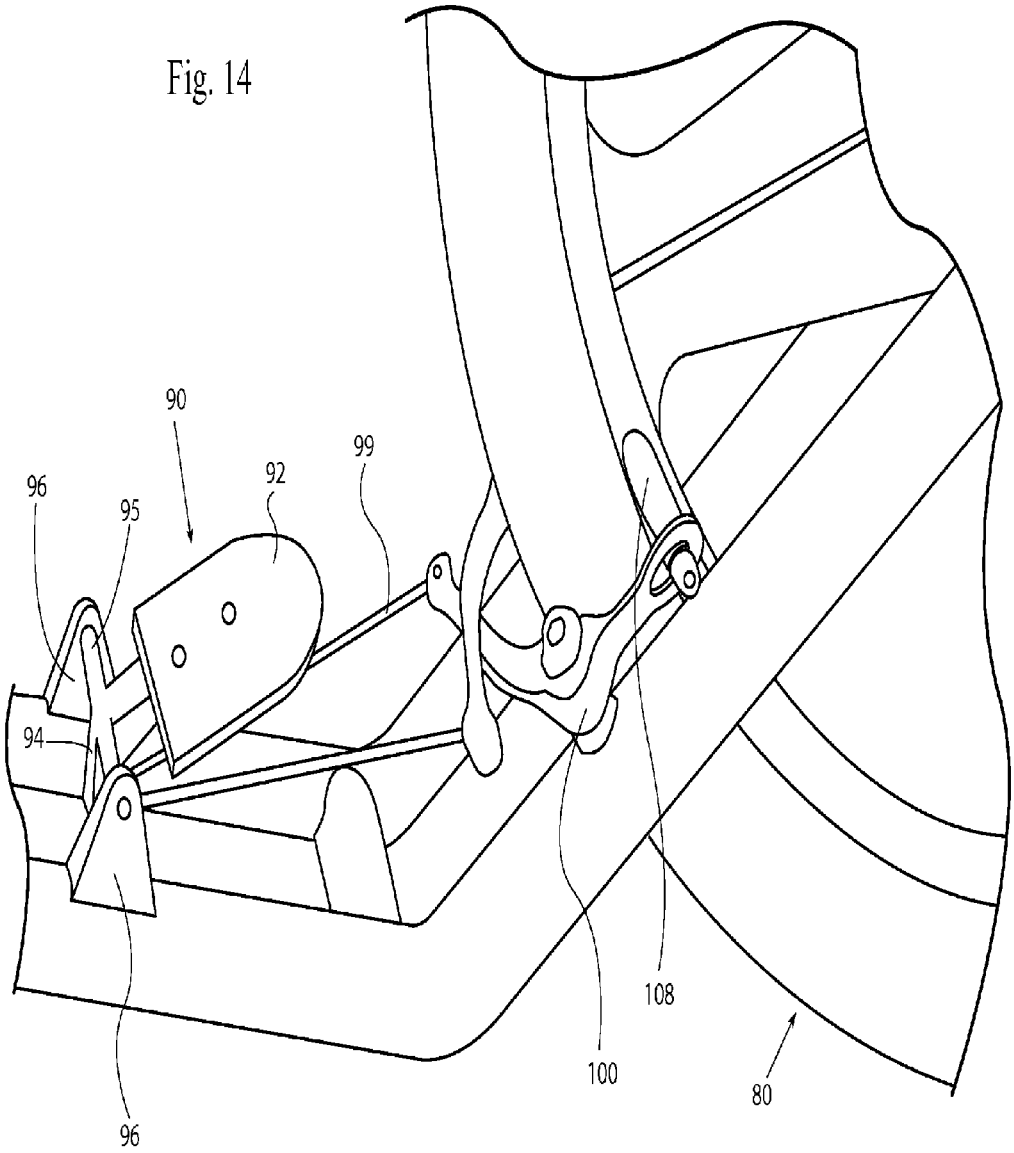
FIG. 14 is an enlarged perspective view of the brake mechanism of the steerable and foldable skateboard of FIG. 1.

FIG. 14 is an enlarged perspective view of the brake mechanism 90 of the steerable foldable skateboard 1 of FIG. 1. Preferably the brake pedal 90 can be suspended in the upward position by a torsion spring. As the brake pedal portion 92 is depressed, it will pull a cable 99 forward which can operate any of the various braking devices used on bicycles including cantilever brakes or a disc brake.

While a U brake configuration is shown, the invention can allow for using any type of pull cable brake assembly, such as but not limited to U-brake, side-pull cantilever brake, disc brake, and the like.

Referring to FIGS. 1-3, 5-7, 9 and 12-14, a generally horizontal depressible pedal 90 with a generally downwardly angled L shaped leg 94 with corner pivot point 95 therebetween pivotally attachable to rear frame pivot mounts 96 on the elongated members 42, 46 on the rear frame 40 by pivot pin 97. Brake cable 99 can attach to catch end 98 on the downwardly angled leg 94 to outer arm ends of each arm of a U brake 108, such as those shown and described in U.S. Pat. No. 4,793,444 to Nagaono and U.S. Pat. No. 6,109,397 to Chen, which are incorporated by reference. Brake shoes (pads) 108 on the opposite ends of the U shaped arms of the U brake 100 can press against the rear rim 84 of the rear wheel 80 when the brake pedal 92 is depressed by the foot of a rider. The brake 90 can be oriented so that the brake shoes 108 can release and the pedal can angle upward to a neutral position when it is not depressed. The use of this U brake 100 with brake shoes 108 does not wear down the tire 82 since the brake shoes 108 rub against the rim 84 and not against the tire 82.

Figure 15:
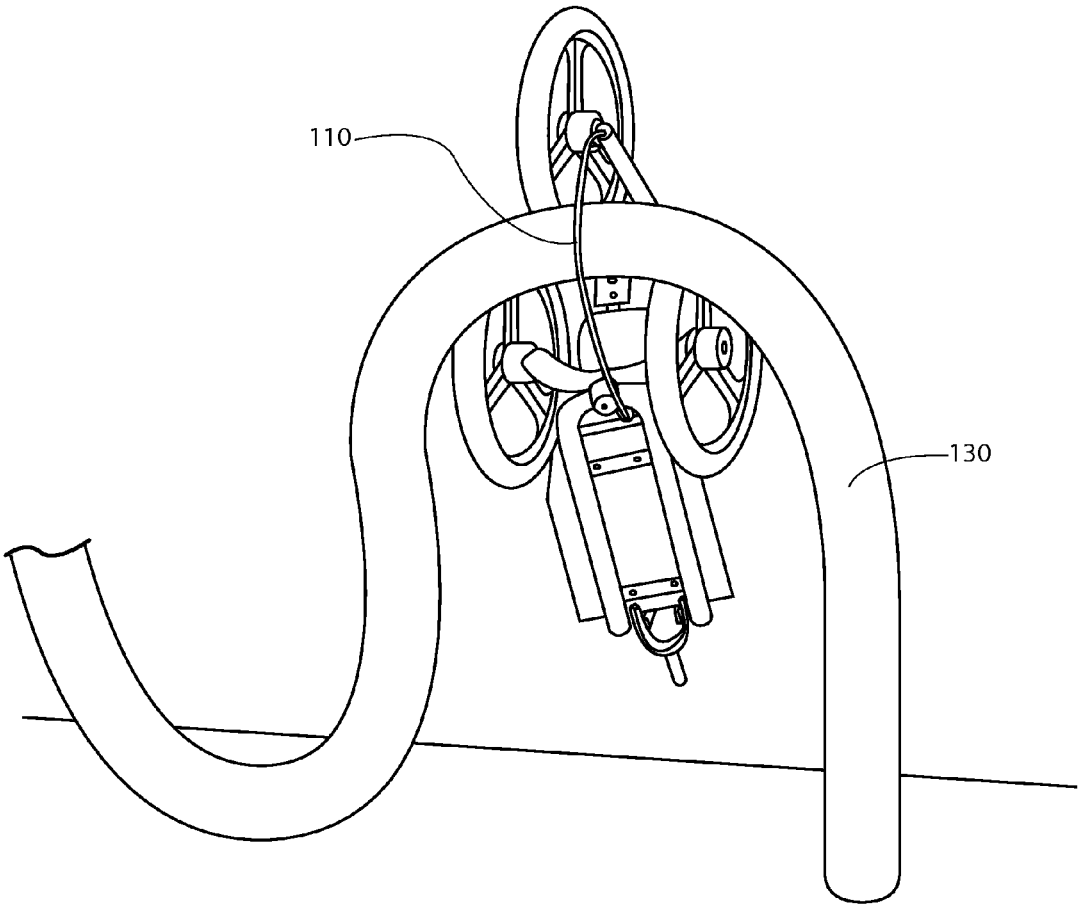
FIG. 15 is a perspective view of the folded skateboard of FIG. 13 with attached lock.

FIG. 15 is a perspective view of the folded skateboard 1 of FIG. 13 with attached lock cable 110. Referring to FIGS. 1, 1A, 1B, 2, 4, 6, 9, 12 and 15, a lock cable 110 can be stored onboard the skateboard 1 by having one end inserted into an open end of a hollow angled bent member 44 on the frame 40 so that one end of the cable 110 can be pulled out when needed. A lock flange 118 with socket attached to a part of the frame 202 can attach the folded skateboard 1 to a support structure such as a bike rack 130 when the skateboard 1 is not being used.

The invention frame can be made from materials such as but not limited to steel, aluminum, composite, metal alloys, and the like. The deck can be made from materials such as but not limited to plastic, wood, metals, and the like. The wheel rims can be made from materials, such as but not limited to plastic, metal, and the like.

Figure 16:
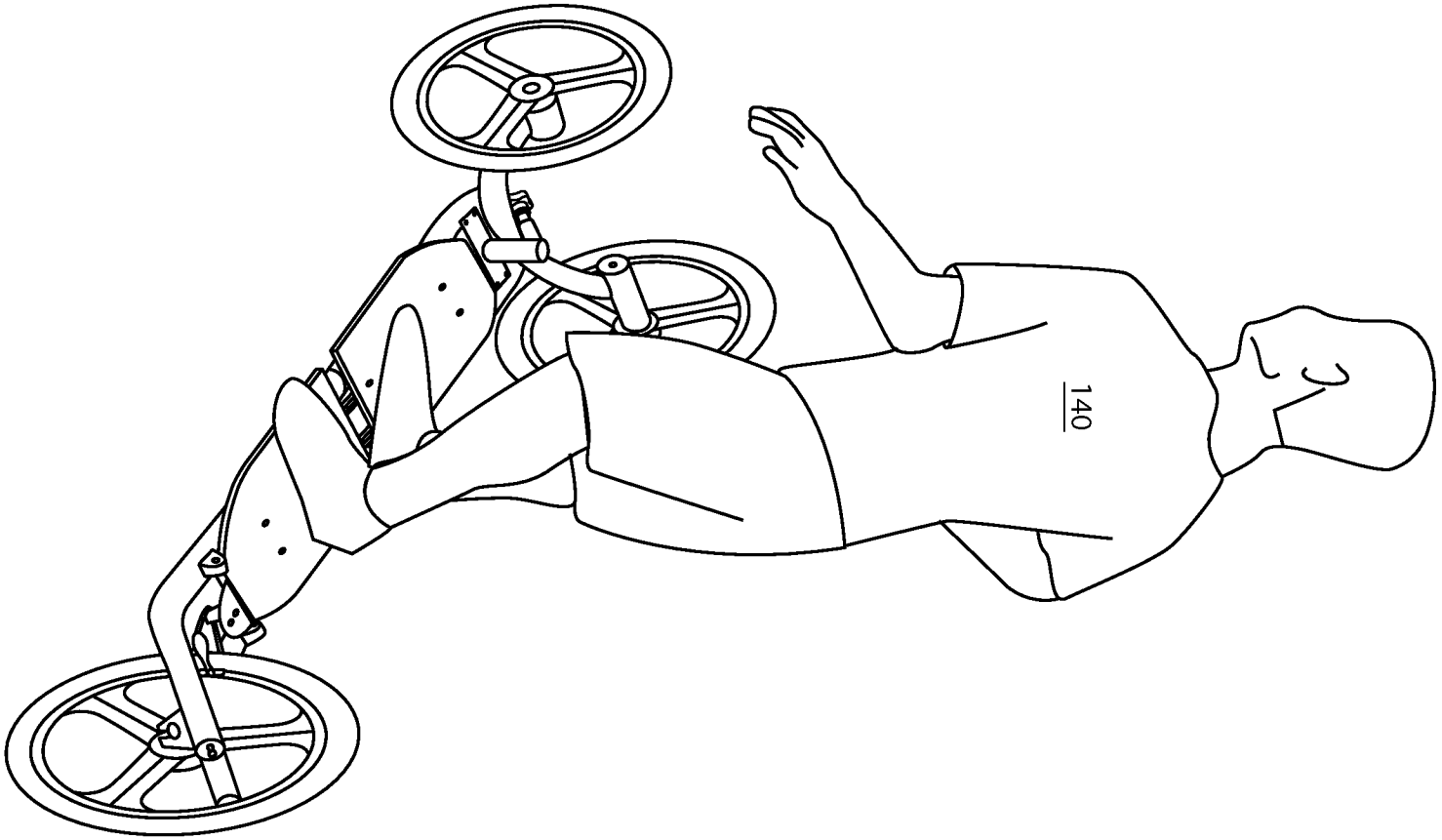
FIG. 16 is a perspective view of a user on the skateboard of FIG. 1.

FIG. 16 is a perspective view of a rider 140 on the extended skateboard 1 of FIG. 1.

Figure 17:
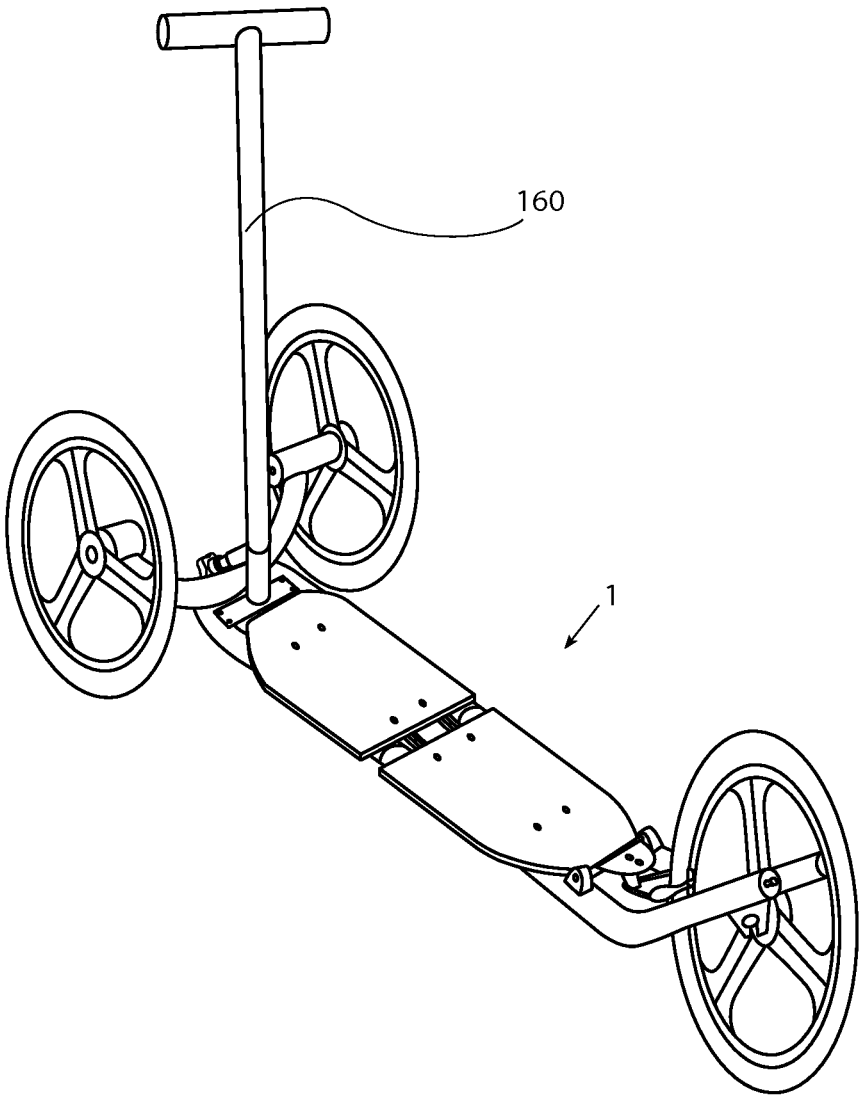
FIG. 17 is a perspective view of the steerable and foldable skateboard with an attached handle.

FIG. 17 is a perspective view of skateboard 1 with an attached handle 160.

Figure 18:
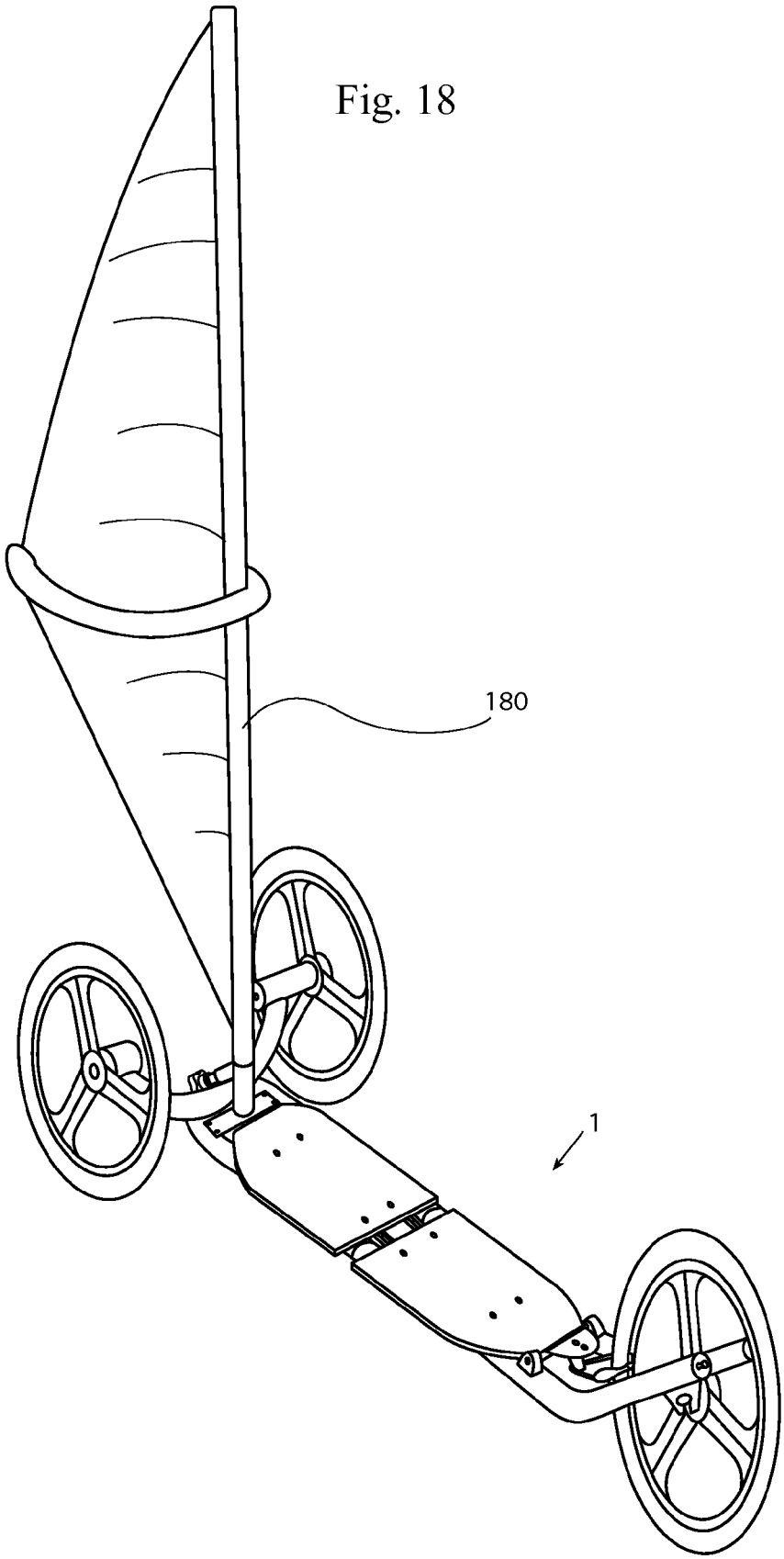
FIG. 18 is a perspective view of the steerable and foldable skateboard with an attached sail.

FIG. 18 is a perspective view of skateboard 1 with an attached sail 180. Referring to FIGS. 1A, 17, and 18, the vertical portion of the stabilizing bolt assembly 206 is to remain open at the top and act as a female receptacle to allow accessories to be attached such as a handle 160 or a sail 180. The handle 160 can provide additional stability for an inexperienced rider and it can be removed when the rider's confidence increases. The sail 180 can provide propulsion by wind for the skateboard 1. The three wheel lean-steer skateboard can be well suited to being modified to be powered by a motor, either gas or magnetic, which can drive the single rear wheel.

Although the invention describes a single pivot point at 64, 61 FIG. 1A, the invention can be practiced with more than one pivot point.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A three wheel steerable skateboard comprising:

a deck having a front end and a back end;

a pair of front wheels;

a forward off vertical angled pivot mount for pivotally attaching the pair of front wheels to the front end of the deck, wherein steering the skateboard is adapted by a rider tilting the skateboard side-to-side;

single rear wheel mounted adjacent to the back end of the deck; and an axle member for attaching the front wheels to one another, and the pivot mount is pivotally attached to the front end of the deck by a single pivot, the pivot mount has:

a raised eyelet on a middle portion of the axle member, the eyelet having an enlarged opening therethrough; and a stabilizing member attached to the skateboard having an angled rod with an end protruding through the enlarged opening in the eyelet with a pliable bushing, the enlarged opening having a larger diameter than the diameter of the rod, the opening being large enough to allow for the front wheels on the axle member with attached eyelet to move to the left and to the right, wherein the stabilizing member stabilizes turning motion of the skateboard when the skateboard is tilted to the right or to the left.

2. The steerable skateboard of claim 1, wherein the single pivot is angled forward by approximately 10 to approximately 45 degrees off vertical which forces the pair of front wheels to turn when the skateboard is tilted side-to-side by the rider.

3. The steerable skateboard of claim 2, wherein the single pivot further includes:

a turn knob for adjusting pivoting tension of the pivot mount.

4. A three wheel foldable and steerable skateboard comprising:

a forward deck having a front end and a back end;

a rear deck having a front end and a back end;

a folding mechanism attached to the back end of the forward deck and the front end of the rear deck, for allowing the rear deck to fold against the front deck;

a pair of front wheels;

a pivot mount for pivotally attaching the pair of front wheels to the front end of the forward deck, wherein steering the skateboard is adapted by a rider tilting the skateboard side-to-side;

single rear wheel mounted adjacent to the back end of the rear deck;

an axle member for attaching the front wheels to one another, and the pivot mount is pivotally attached to the front end of the forward deck by a single pivot;

a forward frame attached underneath the forward deck; and a rear frame attached underneath the rear deck, wherein the rear frame includes a pair of rear elongated members attached in a parallel configuration with each other, and each rear elongated member having a front end and a rear end, the rear end of each rear elongated member angling upward from a mid portion along each rear elongated member, wherein the single rear wheel is attached to the upward angling rear end of each elongated member.

5. The foldable and steerable skateboard of claim 4, wherein the forward frame includes:

a U-shaped member with an apex end and parallel extending ends, with the single pivot attached adjacent to the apex end of the U-shaped member.

6. A three wheel foldable and steerable skateboard comprising:

a forward deck having a front end and a back end;

a rear deck having a front end and a back end;

a folding mechanism attached to the back end of the forward deck and the front end of the rear deck, for allowing the rear deck to fold against the front deck, wherein the folding mechanism further includes a front frame and rear frame having male ends and female ends which couple with each other for stability with the front frame and the rear frame being drawn together by a lever pivotally connected to both the front and rear frames that holds both the front and the rear frames together when folded and tightly draws the front and the rear frames together when unfolded;

a pair of front wheels;

a pivot mount for pivotally attaching the pair of front wheels to the front end of the forward deck, wherein steering the skateboard is adapted by a rider tilting the skateboard side-to-side;

single rear wheel mounted adjacent to the back end of the rear deck;

an axle member for attaching the front wheels to one another, and the pivot mount is pivotally attached to the front end of the forward deck by a single pivot;

a forward frame attached underneath the forward deck; and a rear frame attached underneath the rear deck.

7. The foldable and steerable skateboard of claim 6, wherein the forward frame includes a pair of elongated members mounted in a parallel configuration underneath the forward deck, and the rear frame includes a pair of elongated members mounted in a parallel configuration underneath the rear deck, the folding mechanism for pivotally attaching back ends of the forward frame elongated members to front ends of the rear frame elongated members.

8. The foldable and steerable skateboard of claim 7, further comprising:

an onboard locking cable for locking the skateboard to a fixed structure when the skateboard is not being used, and wherein at least one of the front frame elongated members and the rear frame elongated members includes a hollow interior space, and the locking cable is storable inside of the hollow interior space onboard the skateboard out of the way of the rider, when the skateboard is being ridden and the locking cable is not being used.

* * * * *